US005285906A

United States Patent [19]

Wisnowski et al.

[11] Patent Number: 5,285,906

[45] Date of Patent: Feb. 15, 1994

[54] SKI STORAGE RACK

[76] Inventors: Thomas B. Wisnowski; Gabriele R. Wisnowski; Rachel M. Wisnowski; Kristin A. Wisnowski, all of 614 S. Minnesota St., Mitchell, S. Dak. 57301

[21] Appl. No.: 24,326

[22] Filed: Mar. 1, 1993

[51] Int. Cl.[5] ..... A47F 7/00

[52] U.S. Cl. ..... 211/70.5; 211/62

[58] Field of Search ..... 211/70.5, 62, 60.1, 211/65, 70.6, 70.8, 67, 68

[56] References Cited

U.S. PATENT DOCUMENTS

| | | | |
|---|---|---|---|
| 3,636,739 | 1/1972 | Smedley | 211/70.5 |
| 4,222,490 | 9/1980 | Wood, Jr. | 211/70.5 |
| 4,508,229 | 4/1985 | Yost, Jr. | 211/70.5 |
| 4,621,737 | 11/1986 | Casey | 211/70.5 |
| 4,673,088 | 6/1987 | Mancini | 211/70.5 |
| 4,785,980 | 11/1988 | Redick | 211/70.5 X |

*Primary Examiner*—Alvin C. Chin-Shue
*Assistant Examiner*—Sarah A. Lechok
*Attorney, Agent, or Firm*—E. Michael Combs

[57] ABSTRACT

A space saving rack for storing skis is disclosed. The ski storage rack includes a mounting plate secured to a vertically arranged support member. The mounting plate has a plurality of spaced, horizontally-extending dowel pins attached to it for receiving a plurality of skis and poles vertically positioned therebetween. Resilient retaining clips are detachably mounted on the outer ends of the dowel pins to secure the skis and poles between the dowel pins. A catch basin is positioned on a horizontally arranged support member and is configured for receiving snow and ice melting and dropping from the skis and poles. The catch basin is located below and in vertical alignment with the mounting plate so that the mounting plate and dowel pins overlie the catch basin. The lower ends of the skis and poles are positioned and supported on the catch basin.

9 Claims, 3 Drawing Sheets

SKI STORAGE RACK

BACKGROUND OF THE INVENTION

1. Field of the Invention

The field of the invention relates to sporting equipment storage devices, and more particularly to a space saving apparatus for storing skis.

2. Description of the Prior Art

In the past skis and their associated poles have been stored between uses in a variety of ways. For example, by merely propping them against an outside wall of a building. However, this method exposes the ski equipment to both theft and damage from the outdoor environment. Ski storage has also been effected indoors by merely hanging them on wall hooks or standing them against a wall in storage closet or similar room. These techniques, however, are equally ineffective in that they require larger storage areas, cause storage rooms to become cluttered thus rendering it more difficult to retrieve the skis for use, as well as causing floors to become wet from snow and ice melting and dripping from the skis.

Various indoor storage devices for skis have been utilized in the prior art. For example, U.S. Pat. No. 3,905,481 to Laterra sets forth a rack for vertically storing skis comprising a pair of vertically spaced and aligned unitary brackets. One bracket has a plurality of spaces for receiving one end of the skis, and the other bracket has a shelf to receive the butt ends thereof.

U.S. Pat. No. 4,673,088 to Mancini discloses another ski storage rack for vertically storing a plurality of pairs of skis using an open quadrangular wooden frame which is mountable on a wall. The frame is constructed to store successive pairs of skis in vertically offset relationship so that curved ski tips and bindings are spacedly staggered and interdigitated to maximize the use of the available space of the rack.

U.S. Pat. No. 4,988,007 to Chiarot illustrates still another ski storage rack having a bracket mounted on a vertical surface or support member. A plurality of ski hanger modules are slidably mounted on the bracket and receive the skis therein. Adjacent hanger modules are positioned inverted with respect to each other allowing close ski spacing. The modules and are provided with apertures for receiving locking means to secure the skis in place.

As such, it may be appreciated that there continues to be a need for a new and improved ski storage rack which addresses both the problems of ease of use, portability, and effectiveness in construction, and in this respect, the present invention fulfills this need.

SUMMARY OF THE INVENTION

In view of the foregoing disadvantages inherent in the known types of sporting equipment storage devices now present in the prior art, the present invention provides a ski storage rack which permits the storage of several sets of skis in a safe and uncluttered area of minimal size. As such, the general purpose of the present invention, which will be described subsequently in greater detail, is to provide a new and improved ski storage rack which has all the advantages of the prior art sporting equipment storage devices and none of the disadvantages.

To attain this, the present invention includes a ski storage rack as set forth herein. The ski storage rack utilizes a mounting plate detachably secured to a vertically arranged support member. The mounting plate has a plurality of pairs of dowel pins detachably secured to and extending orthogonally outwardly from the front planar surface of the mounting plate. The dowel pins of each pair are parallel to each other and separated by a distance sufficient to receive a plurality of pairs of skis vertically positioned therebetween. Adjacent pairs of dowel pins are separated by distance sufficient to receive a plurality of ski poles vertically positioned therebetween. Resilient retaining clips are detachably mounted on the outer ends of the dowel pins to secure the skis and poles between the pins. A catch basin is located below and in vertical alignment with the mounting plate and dowel pins and positioned on a horizontally arranged support member. The skis and poles are stacked vertically on the catch basin by positioning their lower ends on a mesh screen or grid located on the upper end of the catch basin. The catch basin is also provided with a drip pan mounted in its lower end for collecting snow and ice melting and dripping from the skis and poles.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the included abstract is to enable the U.S. Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

It is therefore an object of the invention to provide a new and improved ski storage rack which has all the advantages of the prior art sporting equipment storage devices and none of the disadvantages.

It is another object of the present invention to provide a new and improved ski storage rack which may be easily and efficiently manufactured and marketed.

It is a further object of the present invention to provide a new and improved ski storage rack which is of durable and reliable construction.

An even further object of the present invention is to provide a new and improved ski storage rack which is susceptible of a low cost of manufacture with regard to both materials and labor, and which accordingly is then susceptible of low prices of sale to the consuming public, thereby making such ski storage racks economically available to the buying public.

Still yet another object of the present invention is to provide a new and improved ski storage rack which provides in the apparatuses and methods of the prior art some of the advantages thereof, while simultaneously overcoming some of the disadvantages normally associated therewith.

Still another object of the present invention is to provide a new and improved ski storage rack which enables the storage of a maximum number of skis and poles in a minimum indoor area.

Yet another object of the present invention is to provide a new and improved ski storage rack which is of simple construction for enabling safe and uncluttered indoor storage, thereby preventing outdoor material damage.

Even still another object of the present invention is to provide a new and improved ski storage rack which has a collecting means for ice and snow melting and dripping from the skis and poles to prevent wet indoor floors.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
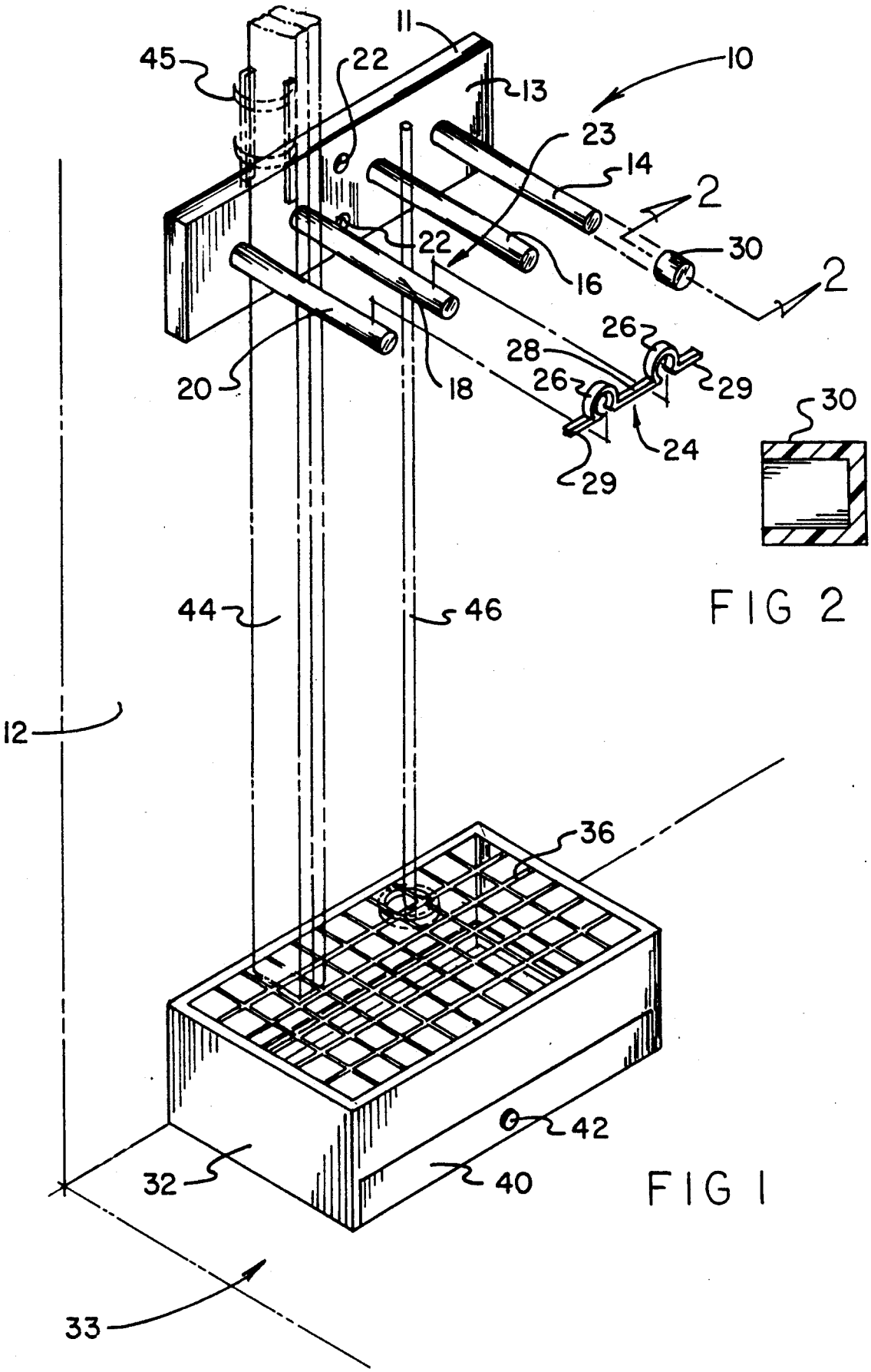
FIG. 1 is a perspective and partially exploded view of the ski storage rack of the present invention.
FIG. 2 is a cross-sectional view of the dowel pin end cap of the present invention as taken along line 2—2 in FIG. 1.

With reference now to the drawings, and in particular to FIGS. 1-9 thereof, a new and improved ski storage rack embodying the principles and concepts of the present invention and generally designated by the reference numeral 10 will be described.

Figures 3, 4:
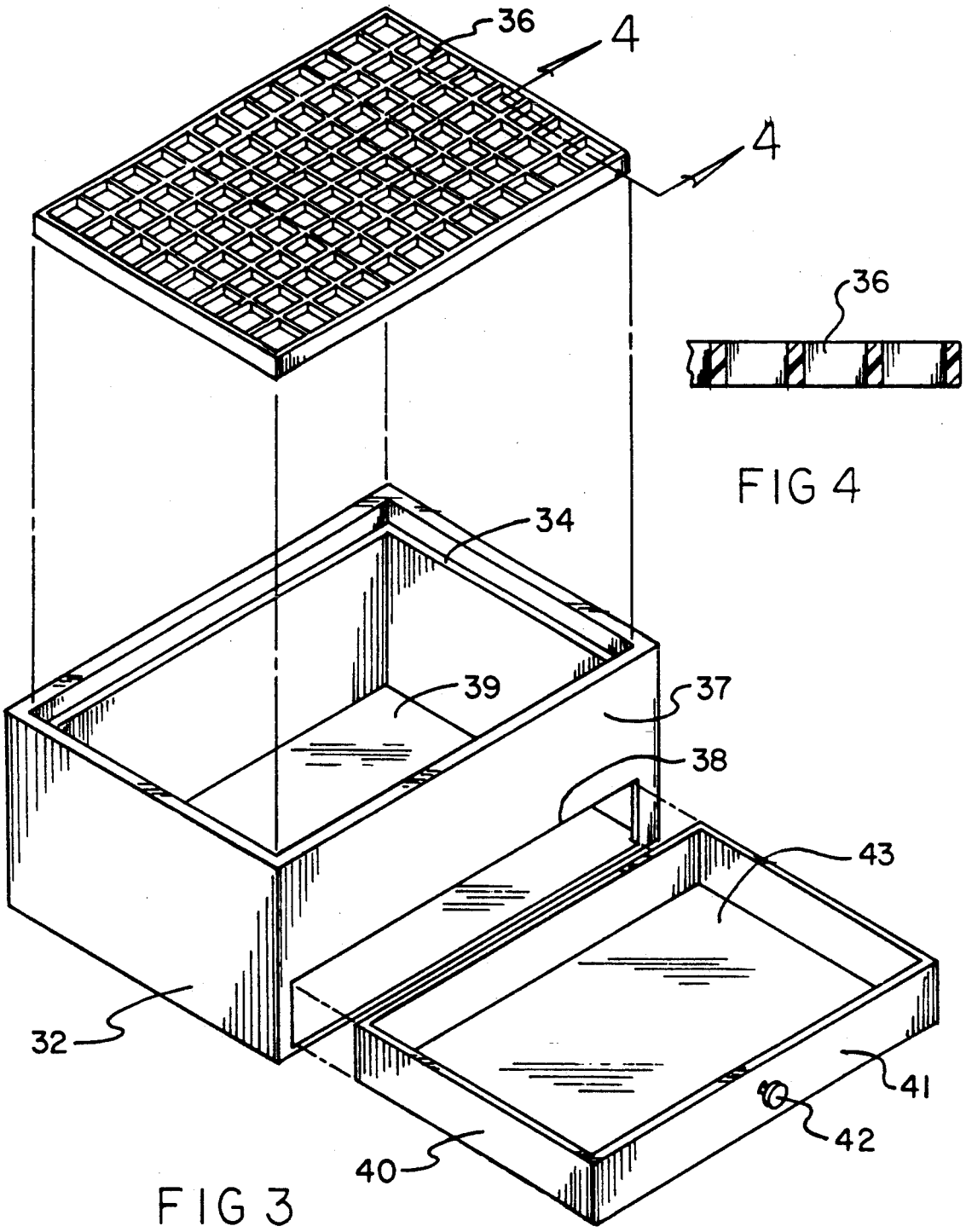
FIG. 3 is a perspective and exploded view of the catch basin of the present invention.
FIG. 4 is a cross-sectional view of the mesh screen of the present invention as taken along line 4—4 in FIG. 3.
Figure 5:
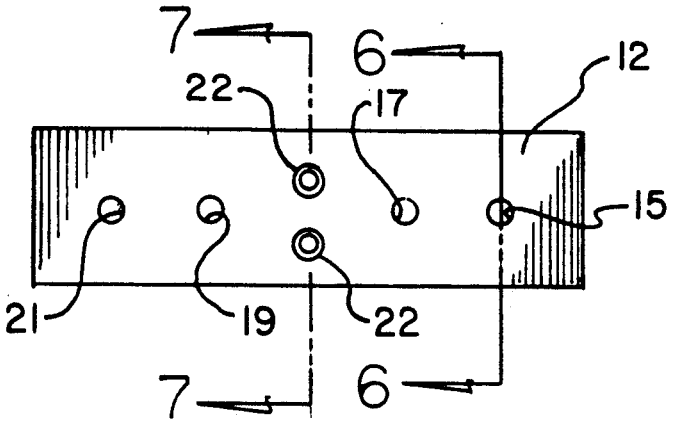
FIG. 5 is a front elevational view of the mounting plate of the present invention.
Figure 6:
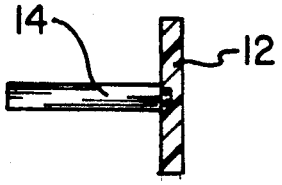
FIG. 6 is a cross-sectional view of the mounting plate of the present invention as taken along line 6—6 in FIG. 5.
Figure 7:
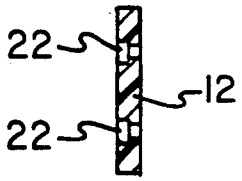
FIG. 7 is a cross-sectional view of the mounting plate of the present invention as taken along line 7—7 in FIG. 5.
Figure 8:
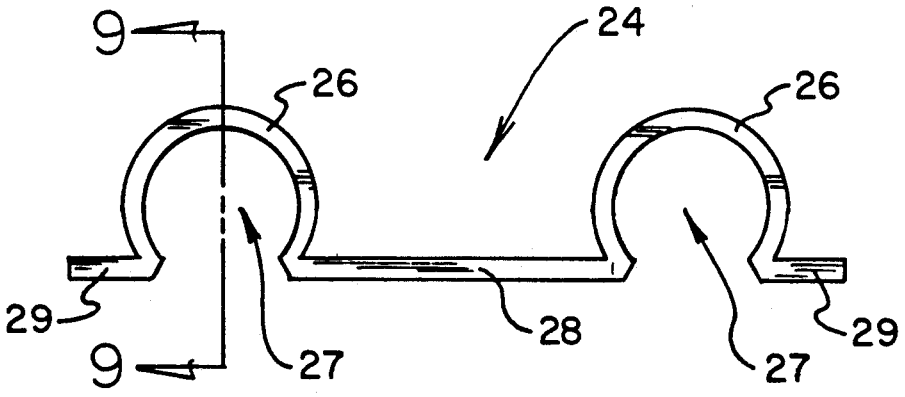
FIG. 8 is a front elevational view of the resilient retaining clip of the present invention.
Figure 9:
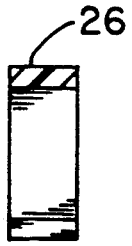
FIG. 9 is a cross-sectional view of the resilient retaining clip of the present invention as taken along line 9—9 in FIG. 8.

More specifically, and with particular reference to FIG. 1, the ski storage rack 10 includes a substantially rectangular mounting plate 11 which may be constructed of rigid polymeric material. Mounting plate 11 is detachably secured to a vertically arranged support member such as an interior wall 12 of a building. As shown in FIGS. 1 and 5-7, mounting plate 11 is provided with two pairs of dowel pin mounting holes 15,17 and 19,21 extending inwardly from front face 13 thereof. Mounting holes 15,17, and 19,21 are laterally aligned on the horizontal center line and equally spaced laterally from the vertical center line of plate 11. Located on the vertical center line of plate 11 are a pair of fastener holes 22 extending through plate 11 for mounting it to a vertical support member such as wall 12. Since binding height varies with ski length, mounting plate 11 is positioned at a height on wall 12 or other similar vertical support member to accommodate the ski bindings 45 (FIG. 1) on the longest pair of skis 44 to be stored in the rack so that bindings 45 of stored skis 44 are not at the same vertical position as dowel pins 14,16,18,20 to interfere with their placement between the dowel pins 14,16,18,20. In other words, the vertical placement of mounting plate 11 on the vertical support member will vary depending upon the length of the skis to be stored. Detachably press-mounted in holes 15,17 and 19,21 are dowel pins 14,16 and 18,20, respectively. Pins 14,16 and 18,20 extend orthogonally outwardly from surface 13 of plate 11 in parallel relationship and are spaced apart by a distance sufficient to receive a plurality of skis 44 between them as shown in FIG. 1. In the space 23 between the pairs of dowel pins 14,16 and 18,20, a plurality of ski poles 46 may be vertically stored as shown in FIG. 1. Retaining clips 24 (FIGS. 1,8, and 9) are provided to secure the skis 44 between dowel pins 14,16 and 18,20 and to secure poles 46 in space 23. Clips 24 have a pair of gripper loops 26 with open ends 27, the loops 26 being integrally joined by a connecting bar 28. Extending laterally outwardly from each loop 26 is a short end leg 29. Clips 24 are resilient and may be formed from rubber or a flexible polymeric material. A clip 24 may be pressed onto the ends of each pair of dowel pins 14,16 and 18,20 by positioning open ends 27 of loops 26 over the dowel pins and then pressing the loops 26 onto the dowel pins so that the pins are seated within the loops 26, thereby closing the spaces between each pair of dowel pins 14,16 and 18,20, and thus capturing or locking skis 44 therein. At the same time, end legs 29 of adjacent clips 24 extend between dowel pins 16,18 to substantially close space 23, thus capturing or locking ski poles 46 therein. An end cap 30 (FIGS. 1 and 2), preferably of polymeric material, is pressed onto the outer end of each dowel pin 14,16,18,20 to protect against slivers. A catch basin 32 is placed on a horizontal support member such as an interior floor 33 of a building (FIG. 1), and is positioned on floor 33 below and in vertical alignment with mounting plate 11 and dowel pins 14,16,18,20. Basin 32 includes a substantially rectangular box which is open at its upper end and may be constructed of rigid polymeric material. Extending around the entire interior periphery of basin 32 at a location adjacent its open upper end is a ledge 34. Resting on ledge 34 is a mesh screen or open grid 36 (FIGS. 1,3, and 4). Screen 36 may be constructed of rigid polymeric material such as Nylon. A front wall 37 of catch basin 32 has a substantially rectangular opening 38 located at a lower portion thereof in a position adjacent the bottom wall 39 of the basin 32. A drip pan 40 comprising a substantially rectangular, open-ended drawer extends through opening 38 and is slidably positioned on the surface of bottom wall 39 of catch basin 32 with its open end facing upwardly. Pan 40, which may be constructed of rigid polymeric material, has a front wall 41 with an operating knob 42 positioned centrally on its outer surface.

In use, mounting plate 11, with dowel pins 14,16,18,20 attached thereto, is mounted on a vertical support member such as wall 12 in a desired vertical position to accommodate the binding of the longest pair of skis to be stored in rack 10 as previously discussed using conventional fasteners (not shown) secured in mounting plate holes 22. Catch basin 32 is positioned on a horizontal support member such as floor 33 in a location below and in vertical alignment with mounting plate and dowel pins 14,16,18,20. A plurality of skis 44 and poles 46 are vertically placed in rack 10 by inserting intermediate portions thereof in the spaces between dowel pin pairs 14,16 and 18,20 and by placing their lower or butt ends on the upper surface of mesh screen 36. A retaining clip 24 is pressed onto each pair of the dowel pins 14,16 and 18,20 to secure or capture skis 44 between the dowel pins and the poles 46 within space 23. As snow and ice on the skis 44 and poles 46 melts, it drops onto and passes through screen 36 and falls into and collects in pan 40. The snow and ice collected in pan 40 may be easily removed from basin 32 by grasping knob 42 and pulling the pan out through opening 38, emptying it, and reinserting it into basin 32. In this manner, melting snow and ice is kept off floor 33 and thus maintained dry. In an exemplary construction of rack 10, catch basin 32 may be dimensioned with a length of 24", a width of 14", and a height of 8". Mounting plate 11 would have a length of 24" and a width of 8", and dowel pins 14,16,18,20 would have a length of 12". With this construction, three pairs of skis 44 may be stored between each pair of dowel pins 14,16 and 18,20, and six poles may be stored in space 23 between the pairs of dowel pins. Accordingly, this exemplary rack 10 can compactly store six pairs of skis 44 and six poles 46 in a minimal area of 13½" by 24". Ski rack 10 may be constructed in any number of sizes to accommodate any number of skis and poles; for example, a rack could be dimensioned to store up to 20 sets of skis and poles in a relatively small area of 3 feet by 3 feet.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ski storage rack comprising:

a vertically arranged first support member;

mounting means detachably connected to said first support member, wherein said mounting means is configured for receiving and securing a plurality of skis and poles in a manner wherein said skis and poles are maintained in a vertical position;

fastener means for detachably securing said mounting means to said first support member;

a horizontally arranged second support member; and receiving means removably located on said second support member, wherein said receiving means is positioned below and in vertical alignment with said mounting means, wherein said receiving means includes a catch basin which is configured as a substantially rectangular box having an open upper end and an opposed lower end having a bottom wall, wherein said catch basin includes a third support member adjacent said open upper end thereof for engaging and supporting outer ends of said vertically positioned skis and poles in vertically aligned and spaced relationship with respect to said bottom wall, and wherein said receiving means further includes container means removably mounted within said catch basin for collecting snow and ice melting and dropping from said skis and poles.

2. The ski storage rack as set forth in claim 1, wherein said catch basin further includes a front wall and a substantially rectangular opening extending through said front wall at a lower portion of said front wall in a position adjacent said bottom wall, wherein said third support member comprises a ledge extending completely around an interior periphery of said catch basin at a position adjacent said open upper end, and a mesh screen removably positioned on said ledge, and wherein said container means comprises a drip pan configured as a substantially rectangular drawer having an open upper end, a front wall, and an operating knob on said pan front wall, wherein said drip pan extends through said rectangular opening and is removably and slidably mounted on said bottom wall with said open upper end thereof facing upwardly for receiving said ice and snow melting and dropping from said skis and poles, passing through said mesh screen, and collecting in said drip pan.

3. The ski storage rack as set forth in claim 2, further comprising a plurality of flexible retaining clips, each of said retaining clips having a pair of gripper loops with open ends, said gripper loops being joined by a connecting bar, and an end leg extending laterally outwardly from each gripper loop at a point adjacent said open end thereof, each of said retaining clips being detachably mounted on an outer end of one of said pairs of dowel pins in a manner wherein a dowel pin is snugly received within each of said gripper loops to enclose each of said first spaces and capture said skis therein, and wherein end legs of adjacent retaining clips extend between each of said pairs of dowel pins to substantially enclose said second spaces and capture said poles therein.

4. The ski storage rack as set forth in claim 3, further comprising a flexible end cap detachably mounted on said outer end of each of said dowel pins.

5. The ski storage rack as set forth in claim 3, wherein said retaining clips are constructed of polymeric material.

6. The ski storage rack as set forth in claim 2, wherein said mounting plate, catch basin, drip pan, and mesh screen are constructed of rigid polymeric material.

7. The ski storage rack as set forth in claim 1, wherein said first support member comprises an interior wall of a building; and wherein said second support member comprises a floor of a building.

8. The ski storage rack as set forth in claim 4, wherein said end caps are constructed of polymeric material.

9. The ski storage rack as set forth in claim 2, wherein said mounting means includes a mounting plate, a plurality of pairs of mounting holes extending into said mounting plate, a fastener hole extending through said mounting plate for receiving said fastener means therein, a plurality of pairs of dowel pins, wherein a dowel pin of each of said pairs is detachably press-mounted in each of said mounting holes and overlies said mesh screen, said catch basin, and said drip pan, wherein said dowel pins of each of said pairs extend orthogonally and horizontally outwardly from said mounting plate and are arranged in parallel relationship and define first spaces between them to receive said skis therein, wherein said pairs of dowel pins are spaced apart and define second spaces between them to receive said poles therein, and wherein said mounting plate is secured to said first support member at a height sufficient to accommodate bindings on a longest pair of skis to be stored in said first spaces.

* * * * *